US012523434B2

(12) United States Patent
Hoysall et al.

(10) Patent No.: US 12,523,434 B2
(45) Date of Patent: Jan. 13, 2026

(54) REFRIGERANT DISTRIBUTION AND CHARGE BALANCING SYSTEM FOR HEAT EXCHANGERS

(71) Applicant: Carrier Corporation, Palm Beach Gardens, FL (US)

(72) Inventors: Dhruv Chanakya Hoysall, South Windsor, CT (US); Thomas Bryant, West Seneca, NY (US); Tobias Sienel, Baldwinsville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 117 days.

(21) Appl. No.: 18/545,446

(22) Filed: Dec. 19, 2023

(65) Prior Publication Data

US 2024/0210127 A1 Jun. 27, 2024

Related U.S. Application Data

(60) Provisional application No. 63/476,784, filed on Dec. 22, 2022.

(51) Int. Cl.

| | |
|---|---|
| ***F28F 9/00*** | (2006.01) |
| ***F28F 1/02*** | (2006.01) |
| ***F28F 1/32*** | (2006.01) |
| ***F28F 9/02*** | (2006.01) |

(52) U.S. Cl.

CPC ..... *F28F 9/0256* (2013.01); *F28F 1/022* (2013.01); *F28F 1/32* (2013.01); *F28F 2260/02* (2013.01)

(58) Field of Classification Search

CPC ..... F28F 9/02; F28F 9/025; F28F 1/32; F28F 1/022; F28F 1/02; F28D 1/05366

See application file for complete search history.

(56) References Cited

U.S. PATENT DOCUMENTS

| | | | | |
|---|---|---|---|---|
| 6,883,596 | B2 | 4/2005 | Kim et al. | |
| 7,828,049 | B2 | 11/2010 | Yamamoto et al. | |
| 8,225,853 | B2 | 7/2012 | Macri et al. | |
| 8,235,101 | B2 | 8/2012 | Taras et al. | |
| 9,752,833 | B2 | 9/2017 | Gao et al. | |
| 10,161,685 | B2 | 12/2018 | Voorhis, Jr. et al. | |
| 10,753,656 | B2 | 8/2020 | Taras et al. | |
| 10,794,634 | B2 | 10/2020 | Wei | |
| 10,852,075 | B2 * | 12/2020 | Voorhis | F25B 41/20 |
| 11,047,625 | B2 | 6/2021 | Huang et al. | |
| 2006/0054310 | A1 | 3/2006 | Kim et al. | |
| 2011/0000255 | A1 | 1/2011 | Taras et al. | |

(Continued)

FOREIGN PATENT DOCUMENTS

| | | | |
|---|---|---|---|
| CN | 203132412 | U | 8/2013 |
| CN | 112146310 | A | 12/2020 |

(Continued)

*Primary Examiner* — Harry E Arant
(74) *Attorney, Agent, or Firm* — Souad Hakim

(57) ABSTRACT

A refrigerant distribution and charge balancing system for a heat exchanger and heat pump is disclosed. The system comprises an auxiliary header that is adapted to be fluidically coupled to a first header of the heat exchanger using one or more tube stubs. The auxiliary header is configured at a predefined distance from the first header. The auxiliary header is adapted to be fluidically coupled to a supply tube associated with a refrigerant line of the heat exchanger.

20 Claims, 5 Drawing Sheets

(56) References Cited

U.S. PATENT DOCUMENTS

| | | | | |
|---|---|---|---|---|
| 2011/0056667 | A1 | 3/2011 | Taras et al. | |
| 2011/0094257 | A1 | 4/2011 | Rusignuolo et al. | |
| 2021/0140713 | A1 | 5/2021 | Leffler et al. | |
| 2022/0099388 | A1 * | 3/2022 | Huang | F28D 1/05391 |

FOREIGN PATENT DOCUMENTS

| | | | | |
|---|---|---|---|---|
| CN | 212362903 | U | | 1/2021 |
| CN | 214701357 | U | * | 11/2021 |

* cited by examiner

REFRIGERANT DISTRIBUTION AND CHARGE BALANCING SYSTEM FOR HEAT EXCHANGERS

CROSS-REFERENCE TO RELATED APPLICATION

This patent application claims the benefit of U.S. Provisional Patent Application No. 63/476,784, filed on Dec. 22, 2022, which is incorporated by reference herein in its entirety.

BACKGROUND

This invention relates to the field of heat exchangers, and more particularly, a refrigerant distribution and charge balancing system for heat exchangers.

The distribution of refrigerant among multiple microchannel tubes of a heat exchanger, and the charge balance between heating and cooling modes in the heat exchanger play significant roles in the overall performance, functioning, and longevity of the heat exchanger. There is, therefore, a need to provide a simple, improved, and cost-effective system that can be easily integrated with heat exchangers to enable efficient refrigerant distribution as well as a charge balancing in the heat exchangers.

SUMMARY

Described herein is a refrigerant distribution and charge balancing system for a heat exchanger. The system comprises an auxiliary header adapted to be fluidically coupled to a first header of the heat exchanger using one or more tube stubs, wherein the auxiliary header is configured at a predefined distance from the first header, and wherein the auxiliary header is adapted to be fluidically coupled to a supply tube associated with a refrigerant line of the heat exchanger.

In one or more embodiments, the heat exchanger is a microchannel heat exchanger comprising the first header, a second header, and a plurality of microchannel tubes extending between and fluidically coupling the first header and the second header.

In one or more embodiments, the auxiliary header is configured parallel to the first header at a predefined height above the first header.

In one or more embodiments, the plurality of tube stubs protrudes from the auxiliary header and extends up to the first header making a predefined angle from a horizontal plane of the auxiliary header in a downward direction.

In one or more embodiments, each of the tube stubs is a hollow member whose longitudinal axis is oriented perpendicular to a longitudinal axis of the auxiliary header, wherein the plurality of tube stubs are configured parallelly with a predefined gap therebetween.

In one or more embodiments, the auxiliary header comprises a hollow cylindrical member defining the shape of the auxiliary header, wherein the supply tube of the heat exchanger is fluidically connected to a base at one end of the auxiliary header.

In one or more embodiments, a cylindrical surface of the auxiliary header comprises a plurality of first slots, and a cylindrical surface of the first header comprises a plurality of second slots, wherein each of the first slots is adapted to accommodate a first end of one of the plurality of the tube stubs and each of the second slots is adapted to accommodate a second end of the corresponding tube stubs, such that the plurality of tube stubs extend parallelly between the auxiliary header and the first header.

In one or more embodiments, the auxiliary header has a predefined radius greater than a radius of the first header.

In one or more embodiments, the auxiliary header has a predefined radius less than or equal to a radius of the first header.

Also described herein is a heat exchanger comprising a first header, a second header fluidically coupled to the first header, and an auxiliary header fluidically coupled to the first header using one or more tube stubs. The auxiliary header is configured at a predefined distance from the first header, wherein the auxiliary header is adapted to be fluidically coupled to a supply tube associated with a refrigerant line of the heat exchanger.

In one or more embodiments, the heat exchanger comprises a plurality of microchannel tubes extending between and fluidically coupling the first header and the second header of the heat exchanger.

In one or more embodiments, the heat exchanger comprises a plurality of heat-dissipating fins extending between adjacent tubes among the plurality of microchannel tubes.

In one or more embodiments, the heat exchanger comprises an auxiliary distributor fluidically coupled to the supply tube within the auxiliary header.

In one or more embodiments, the heat exchanger is associated with an indoor unit that is adapted to be fluidically coupled to a plurality of round tube plate fins (RTPF) coils associated with an outdoor unit.

In one or more embodiments, the auxiliary header is configured parallelly at a predefined height above the first header.

In one or more embodiments, the plurality of tube stubs protrudes from the auxiliary header and extends up to the first header making a predefined angle from a horizontal plane of the auxiliary header in a downward direction.

In one or more embodiments, the one or more tube stubs have a varying diameter along a longitudinal axis of the first header, wherein the diameter of the one or more tube stubs increases or decreases from a first end to a second end of the first header.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
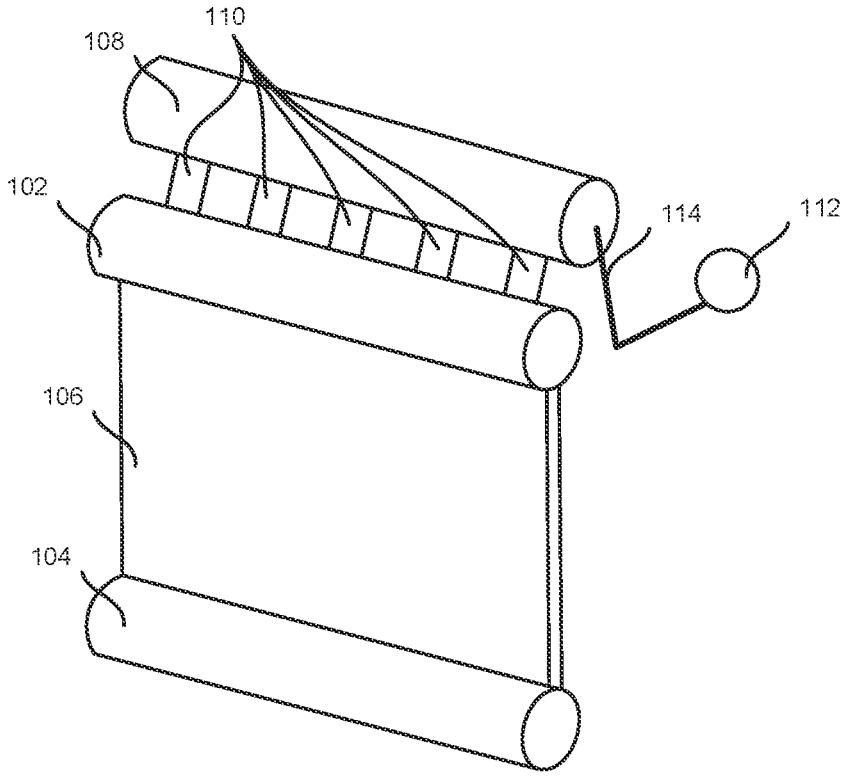
FIGS. 1A and 1B illustrate exemplary views of a refrigerant distribution and charge balancing system implemented in a slab-coil design heat exchanger.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the auxiliary header, multichannel tube, first and second header, heat exchanger, and corresponding components, described herein may be oriented in any desired direction.

Heat exchangers such a microchannel heat exchangers (MCHX) include multiple microchannel tubes having multiple inlet ports, which connect and extend from an inlet manifold (first header) to an outlet manifold (second header) of the heat exchanger. The distribution of fluid among the multiple microchannel tubes plays a significant role in the overall performance of the heat exchanger and effective utilization of the heat transfer surface. This is also applicable to other category of heat exchangers such as brazed plate heat exchanger, round tube plate fin heat exchanger, and the like. In addition, as the heat exchangers are used across various air conditioners and heat pumps, they generally have a refrigerant charge imbalance between heating and cooling modes. Heat pumps typically have a charge imbalance between heat and cooling modes, which may be created due to excess charge generated between heating and cooling modes.

Existing refrigerant charge management strategies are not large enough to store the excess refrigerant charge of the heat pumps. This refrigerant charge imbalance can damage the heat exchanger as well as the overall cooling and heating system, leading to a drop in performance, and system shutdowns in severe conditions. Moreover, this refrigerant charge imbalance is exacerbated with the use of the microchannel coils in MCHX as they have much smaller internal volumes. Thus, refrigerant distribution and charge management strategies are the biggest bottlenecks in the adoption of MCHX in heat pumps. Disclosed herein is a simple, compact, and efficient refrigerant distributor and charge balancing system for the first header of heat exchangers, which enables even distribution of refrigerant across ports of the tubes within the header of the heat exchanger with minimal pressure drop and also facilitates charge balancing and compensation.

Referring to FIG. 1A to 2B, the refrigerant distributor and charge balancing system ("system") for a microchannel heat exchanger ("heat exchanger") is disclosed. The heat exchanger includes an inlet manifold 102 (also referred to as first header 102, hereinafter), an outlet manifold 104 (also referred to as second header 104, hereinafter), and a plurality of microchannel tubes 106 extending between and fluidically coupling the first header 102 and the second header 104. The refrigerant distributor and charge balancing system is designed as a single housing forming an auxiliary header 108 (in addition to the first and second header 102, 104 of the heat exchanger). The heat exchanger may be associated with a refrigeration system and/or with an indoor unit of a heat pump. A supply tube 114 associated with a refrigeration line and a thermal expansion valve 112 of the heat exchanger is adapted to be fluidically connected to one of the ends of the auxiliary header 108, unlike the existing heat exchangers where the supply tube/refrigerant line 114 is directly connected to the first header 102 (inlet manifold). Further, the auxiliary header 108 is adapted to be fluidically coupled to the first header 102 of the heat exchanger using one or more tube stubs 110 such that the auxiliary header 108 remains configured at a predefined distance from the first header 102 of the heat exchanger with the tube stubs 110 configured parallelly and separated by a predefined gap therebetween. In some embodiments, the auxiliary header 108 and tube stubs 110 may be removably coupled to the first header 102 of the heat exchanger, however, the auxiliary header 108 and tube stubs 110 may also be an integral part of the heat exchanger. The tube stubs 110 and auxiliary header 108 act as a distributor that facilitates even distribution of refrigerant over the inlet ports of the microchannel tubes 106 within the first header 102 of the heat exchanger.

Figure 1B:
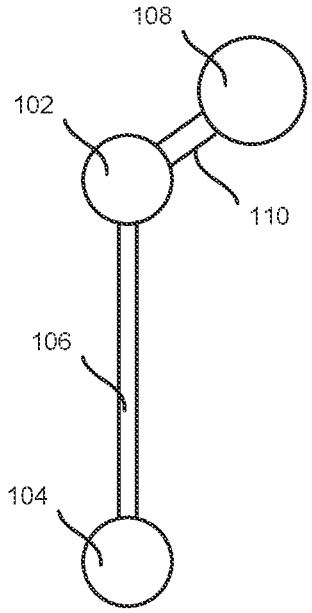
Figure 1C:
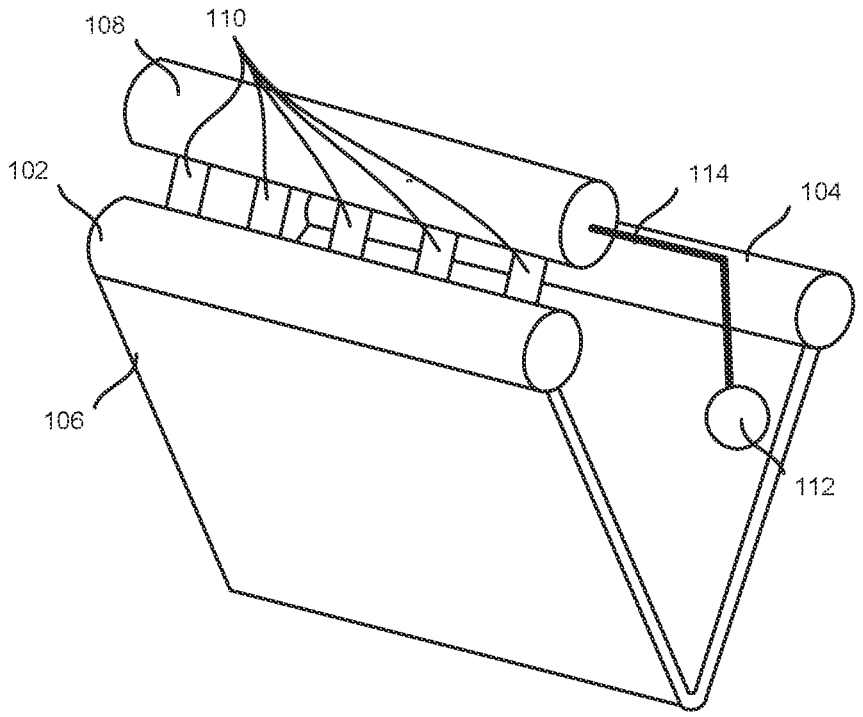
FIGS. 1C and 1D illustrate exemplary views of the refrigerant distribution and charge balancing system implemented in a V-coil heat exchanger.
Figure 1D:
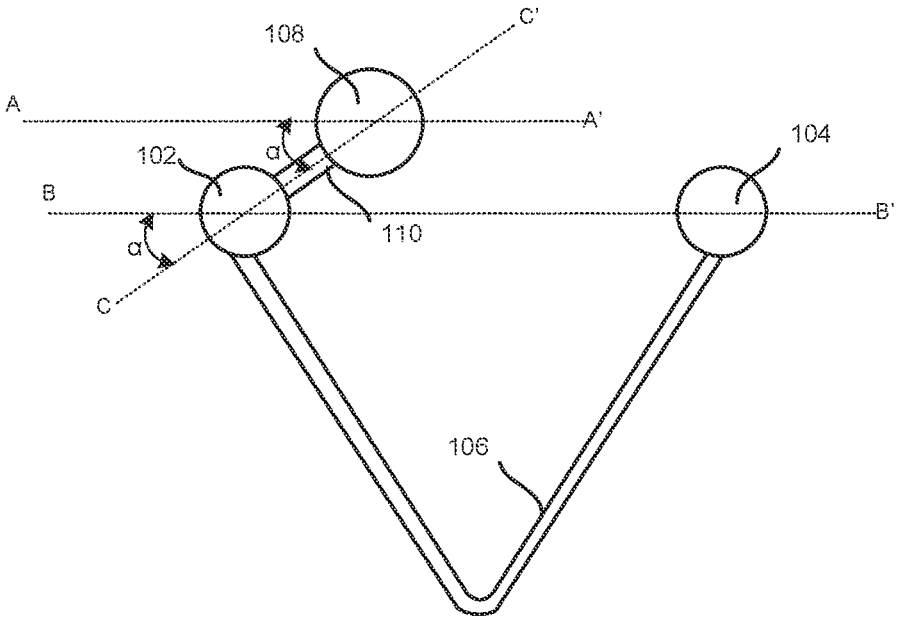

In one or more preferred embodiments, the auxiliary header 108 may be configured parallel to the first header 102 and at a predefined height above (from the horizontal plane of) the first header 102 such that the longitudinal axis, as well as the horizontal plane of the auxiliary header 108 and the first header 102, remain parallel. As illustrated in FIG. 1D, the tube stubs 110 may protrude from the auxiliary header 108 (along axis C-C') and extend up to the first header 102 making a predefined angle ($\alpha$) from the horizontal plane (along axis A=A' or B-B') of the auxiliary header 108 in a downward direction.

Further, the auxiliary header 108 may be disposed of within the housing of the heat exchanger (an area between the first header 102 and second header 104, but in proximity to the first header 102), which may facilitate efficient packaging of the auxiliary header 108 and keeping the overall heat exchanger or indoor unit compact. However (not shown), in some embodiments, the auxiliary header 108 and the first header 102 may be at the same elevation such that the auxiliary header 108 and the first header 102 remains in the same horizontal plane, however, the longitudinal axis of the auxiliary header 108 and the first header 102 may remain parallel or nonparallel to each other. Further, in other embodiments, the auxiliary header 108 may be configured parallel to the first header 102 and at a predefined height below the horizontal plane of the first header 102 without any limitation. Furthermore, the auxiliary header 108 may be configured nonparallel to the first header 102 such that the longitudinal axis of the auxiliary header 108 and the first header 102 remains nonparallel to each other.

The tube stubs 110 may have a predefined length based on a separation distance to be fixed between the auxiliary header 108 and the first header 102. The tube stubs 110 may be configured parallelly to each other and extending between the outer surfaces of the auxiliary header 108 and the first header 102, such that the auxiliary header 108 remains at the predefined distance (equal to the predefined length of the tube stub 110) or predefined height from the first header 102. In one or more embodiments, the tube stubs 110 of the predefined length may protrude from an outer surface of the auxiliary header 108 (along axis C-C') and extend up to the first header 102 making a predefined angle ($\alpha$) from the horizontal plane (along axis A-A') of the auxiliary header 108 in a downward direction, such that the auxiliary header 108 remains at the predefined distance and inclined at the predefined angle ($\alpha$) from the first header 102. In other embodiments, the tube stubs 110 may protrude perpendicularly upward from the outer surface of the first header 102 (along axis B-B') along a vertically perpendicular axis with respect to the horizontal plane of the first header 102 and extend up to the auxiliary header 108 of the auxiliary header 108 in an upward direction, such that the auxiliary header 108 remains vertically above the first header 102.

In one or more embodiments, the one or more tube stubs 110 may have a varying diameter along a longitudinal axis of the first header 102. The diameter of the tube stubs 110 may increase or decrease from a first end to a second end of the first header 102 or the auxiliary header 108. However, in other embodiments, each of the tube stubs 110 may also have the same diameter.

Figure 3:
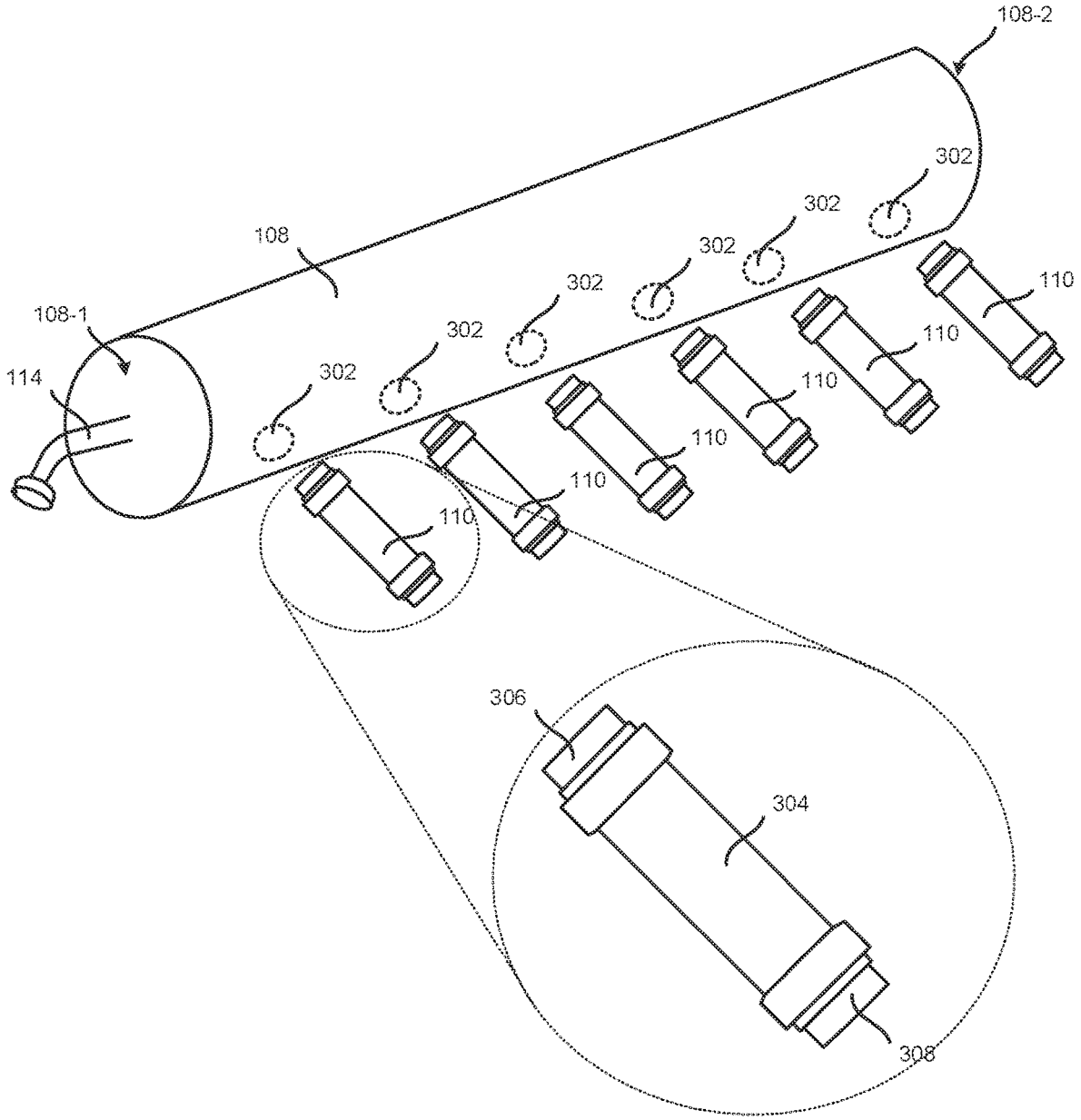
FIG. 3 is an exemplary exploded view of the auxiliary header and the tube stubs of the refrigerant distribution and charge balancing system.

In one or more embodiments, the auxiliary header 108 and the first header 102 may be a hollow member having a cylindrical profile. Referring to FIG. 3, the cylindrical surface of the auxiliary header 108 may include a plurality of first slots 302. Further (not shown), the cylindrical surface of the first header 102 may also include a plurality of second slots. Further, each of the tube stubs 110 can be a hollow member 304 of the predefined length having a first open 306 end and a second open end 308. The first slots 302 of the auxiliary header 108 can be adapted to accommodate and attach the first end 304 of one of the tube stubs 110 and each of the second slots of the first header 102 can be adapted to accommodate and attach the second end 308 of the corresponding tube stubs. The first and second ends 306, 308 of each tube stubs 110 can be configured with one of the first slots 302 of the auxiliary header 108 and second slots the first header 102, such that the tube stubs 110 extend parallelly between the auxiliary header 108 and the first header 102, with a predefined gap between two adjacent tube stubs 110.

In one or more embodiments (not shown), the size of the opening at the first end 306 of tube stubs 110 (connected to the auxiliary header 108) may be kept lesser than the opening at the second end 308 such that each of the tube stubs 110 may act as a nozzle, which may further facilitate in even/uniform distribution of refrigerant across inlet ports of the microchannel tube within the first header 102. In addition, the distance between the tube stubs 110 may also be adjusted based on the length and volume of the first header 102 to facilitate even/uniform distribution of refrigerant across the inlet ports of the microchannel tubes 106 within the first header 102.

The orientation of the auxiliary header 108 and the first header 102 can be adjusted to bring the first slots and second slots in line with each other and then the two ends of the tube stubs 110 can be accommodated in the corresponding slots. Once the two ends 306, 308 of the tube stubs 110 are accommodated in the corresponding slots of the auxiliary header 108 and the first header 102, the auxiliary header 108 and the first header 102 can preferably be welded or brazed with the tube stubs 110. The first slots 302 and second slots are punched in the sides (cylindrical surface) of the auxiliary header 108 and the first header 102, respectively. Further, (not shown) the auxiliary header 108 and the first header 102 may be provided with substantially spherical domes between the first slots 302 to improve the pressure resistance of the auxiliary header 108 and the first header 102.

In one or more embodiments, the supply tube 114 may be directly disposed of within the auxiliary header 108 through a flat base at one of the ends 108-1 of the inlet auxiliary header 108 as shown in FIG. 3 such that the supply tube 114 remains parallel to a longitudinal axis of the auxiliary header 108. Further, an additional distributor (212 of FIG. 2B) in form of a nozzle may be fitted at an outlet of the supply tube 114 within the auxiliary header 108 such that the refrigerant ejected by the distributor/nozzle within the auxiliary header 108 nearly covers the entire diameter and length of the auxiliary header 108. However, in other embodiments (not shown), the supply tube 114 may have an L-shaped profile with a first section extending upward within the auxiliary header 108 from the bottom of the auxiliary header 108 and a second section extending perpendicular to the first section such that the second section of the supply tube 114 remains parallel to a longitudinal axis of the auxiliary header 108.

Figure 2A:
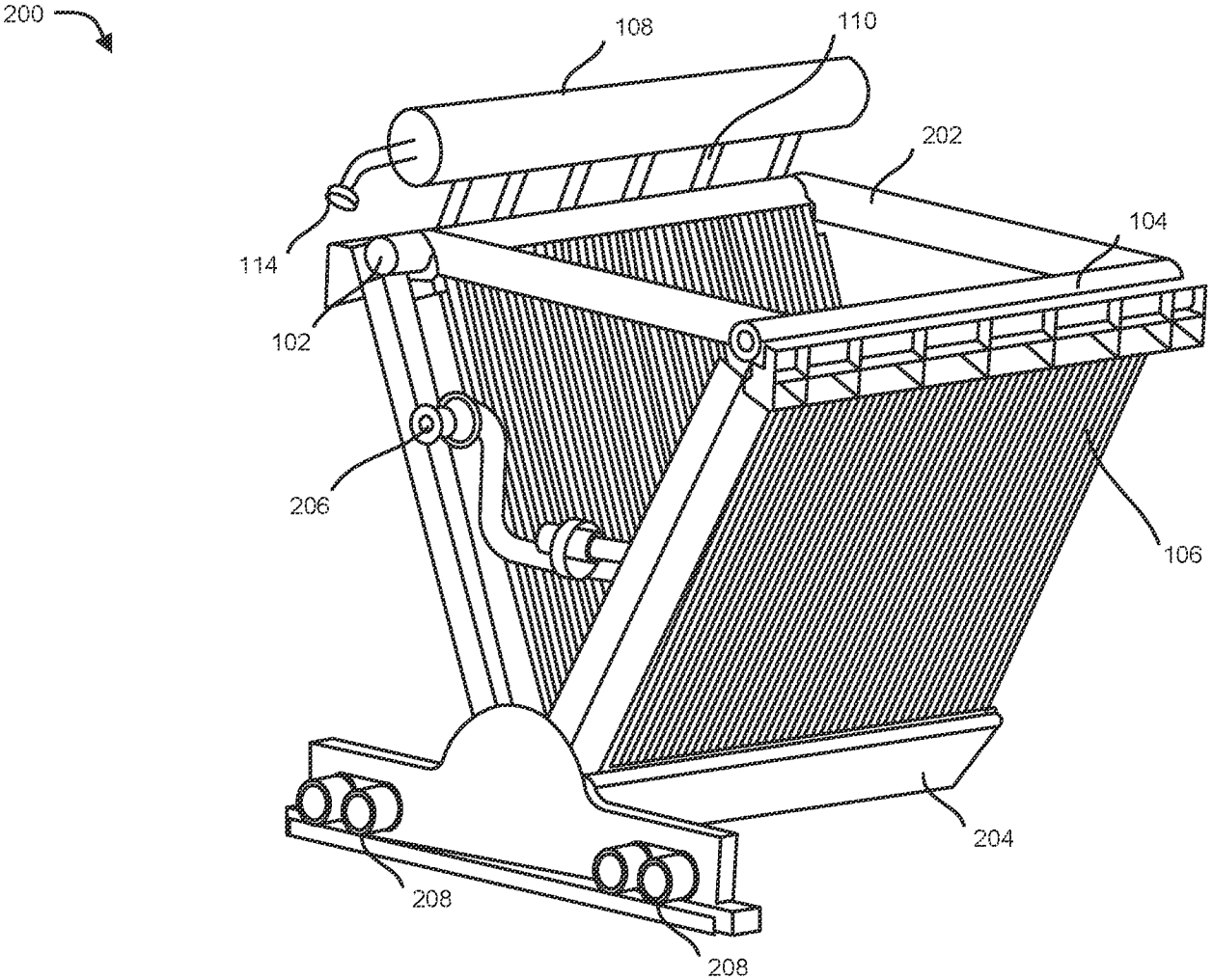
FIGS. 2A and 2B illustrate exemplary views of a heat exchanger having the refrigerant distribution and charge balancing system configured with the first header system.
Figure 2B:
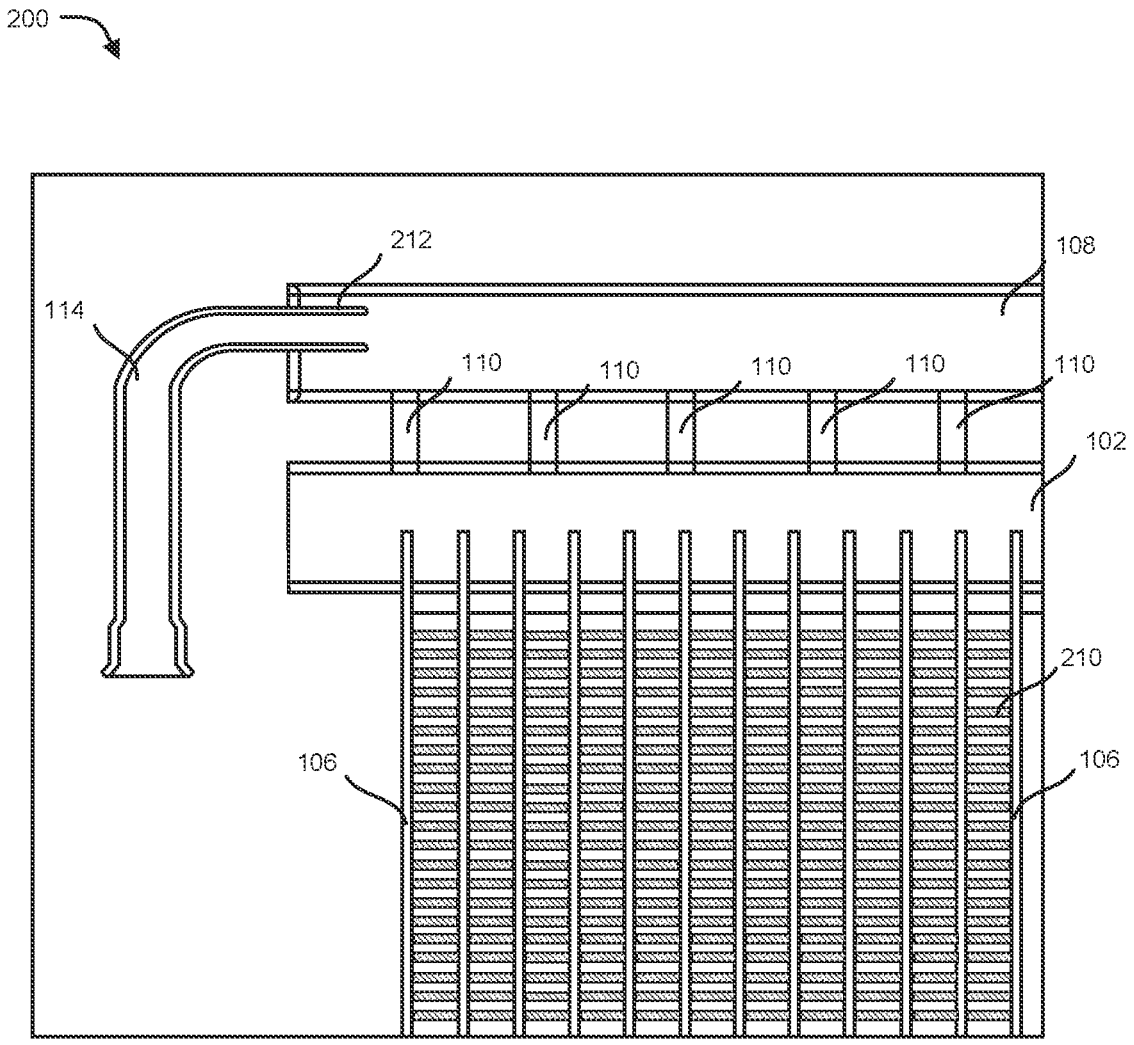

Referring to FIGS. 2A and 2B, an exemplary embodiment of the heat exchanger 200 is illustrated. The heat exchanger 200 includes an inlet manifold 102 (first header or inlet header) and an outlet manifold 104 (second header or outlet header), which may preferably be configured horizontally over a support structure 202 at the same elevation, however, in other embodiments, the first header 102 may also be positioned at an elevated height above the second header 104. Further, the heat exchanger 200 includes a plurality of multichannel tubes ("tubes") 106 in fluidic communication with the first header 102 and the second header 104. The tubes 106 are equally spaced and extend parallelly, with one end (first end) of the tube disposed of within the first header 102 and the other end extending out of the first header 102 at a predefined angle ($\alpha$) and further connected to and disposed of in the second header 104 forming a V-coil design as shown in FIG. 2A. However, the tubes 106 can also extend vertically downward from the first header 102 to enable flow of the fluid in the vertically downward direction in case of downward fluid flow heat exchanger as shown in FIGS. 1A and 1B. Further, in other embodiments (not shown), the tubes 106 can also extend vertically upward from the first header 102 to enable flow of the fluid in the vertically upward direction in case of upward fluid flow heat exchangers.

The heat exchanger 200 further includes a refrigerant distributor and charge balancing system that can be designed as a single housing forming an auxiliary header 108 (in addition to the first and second header 104 of the heat exchanger 200). The auxiliary header 108 is fluidically coupled to the first header 102 of the heat exchanger 200 using one or more tube stubs 110 such that the auxiliary header 108 remains configured at a predefined distance from the first header 102 of the heat exchanger 200 with the tube stubs 110 configured parallelly and separated by a predefined gap therebetween. The tube stubs 110 and auxiliary header 108 act as a distributor that facilitates even distribution of refrigerant over the inlet ports of the microchannel tubes 106 within the first header 102 of the heat exchanger 200, thereby improving the performance, efficiency, and longevity of the overall heat exchanger 200.

The auxiliary header 108 and the first header 102 may be a hollow member having a cylindrical profile. Referring to FIG. 3, the cylindrical surface of the auxiliary header 108 may include a plurality of first slots 302. Further (not shown), the cylindrical surface of the first header 102 may also include a plurality of second slots. Each of the tube stubs 110 can be a hollow member 304 of the predefined length having a first open end 306 and a second open end 408 as shown in FIG. 3. The first slots 302 of the auxiliary header 108 can be adapted to accommodate and attach the first end 306 of one of the tube stubs 110 and each of the second slots of the first header 102 can be adapted to accommodate and attach the second end 308 of the corresponding tube stubs 110. Once the two ends of the tube stubs 110 are accommodated in the corresponding slots of the auxiliary header 108 and the first header 102, the auxiliary header 108 and the first header 102 can preferably be welded or brazed with the tube stubs.

The microchannel tubes 106 includes a hollow member which may preferably have a flat profile having opposite flat walls, however, the tube 106 may also have other profiles without any limitations and all such embodiments are well within the scope of this invention. Further, tube 106 includes multiple channels configured along an axis of the tube 106 therewithin and extending parallelly between a first end and a second end of the hollow member such that multiple fluid flow paths of a predefined radius (for example, generally in the range of millimeters) are created between the first end and second end of the tube 106, which allows fluid such as refrigerant to flow from inlet ports of channels at the first end to the outlet ports of the channels at the second end of the tube 106.

Tubes 106 are preferentially made of a lightweight, thermally conductive, and chemical-resistant material; however, the tubes 106 may also be made of other materials as well. In one embodiment, tube 106 may be made of aluminum extrusions. The tubes 106 are shown in drawings hereof, for ease and clarity of illustration, as having a fixed number of channels defining flow paths having a square cross-section. However, it is to be understood that in commercial applications, such as for example refrigerant vapor compression systems, each multichannel tube 106 typically has about ten to twenty flow channels, but may have a greater or a lesser multiplicity of channels, as desired.

The first end of the tube 106 is adapted to be disposed of within the first header 102 of the heat exchanger 200 using the brazing technique, 3-D printing technique, and other known techniques known in the art, such that a certain portion (near the first end) of the tube 106 is disposed of within the first header 102 and rest portion of the tube 106 protrudes out of the first header 102 in the downward (or upward) direction from the outer surface of the first header 102. Further, the second end of the tube 106 is adapted to be disposed of within the second header 104 of the heat exchanger 200 using the brazing technique, 3-D printing technique, and other known techniques known in the art, such that a certain portion (near the second end) of the tube 106 is disposed of within the second header 104.

The headers 102, 104 are preferably made up of cylindrical, aluminum tubing/housing having aluminum braze cladding on its exterior surface, however, the headers 102, 104 may also have a square, rectangular, hexagonal, octagonal, or other polygonal cross-section. On their facing sides, the headers 102, 104 are provided with a series of generally parallel openings for the receipt of the corresponding ends of the tubes 106, such that the ends or sections of the tubes 106 remain within the headers 102, 104. The tubes 106 are preferably formed of aluminum extrusions. The headers 102, 104 are preferably welded or brazed with the tubes 106. Further, each of the headers 102, 104 is provided with substantially spherical domes to improve the pressure resistance of the headers 102, 104. The headers 102, 104 have opposite ends closed by caps brazed or welded thereto. In the preferred embodiment, the various components are all brazed together, and accordingly, in the usual case, brazing is employed to fasten the caps on opposite ends of the headers 102, 104.

In an embodiment, a third slot based on the diameter of the supply tube 114 is punched at one end of the auxiliary header 108 and the supply tube 114 is inserted within the auxiliary header 108 followed by brazing the supply tube 114 with the auxiliary header 108. An additional distributor or nozzle 212 is fitted at the outlet of the supply tube 114 within the auxiliary header 108 and the ends of the auxiliary header 108 are closed by caps using brazing or welding technique to provide a leak-proof design. In another embodiment, the supply tube 114 may also be attached to or disposed within the auxiliary header 108 using 3-D printing techniques, and other known techniques known in the art.

Further, the heat exchanger 200 includes louvered heat-dissipating fins 210 of brazed-clad aluminum extending parallelly between adjacent microchannel tubes 106. The fins 210 facilitate the exchange of heat between the fluid flowing through the tubes 106 and air flowing across the tubes 106 of the heat exchanger 200. Besides, the fins 210 also provide structural support and rigidity to the tubes 106 as well as the heat exchanger 200.

In one embodiment, as shown in FIG. 2A, the heat exchanger 200 can be a V-coil arrangement heat exchanger having the first header 102 and the second header 104 oriented horizontally in the same plane over the support structure. Further, tubes 106 protrude from the first header 102 making an acute angle from the plane of the first header 102 in a downward direction and further extending in an upward direction at the same acute angle into the second header 104, such that the V-coil arrangement of the tubes 106 having a bend at bottom mid-point of the tubes is formed. The bend at the bottom of tubes 106 results in the formation of an apex at the approximate midpoint of the V-shaped tubes 106. The apex is below the plane defined by the headers 102, 104. Further, a condensate trough 204 is attached along the apex or bend of the tubes by fasteners, extending along an axis parallel to the longitudinal axis of the headers 102, 104. Trough 204 is configured to collect condensate formed in the tubes 106 and the V-coil arrangement facilitates an easier flow of condensate towards the bottom trough 204. The trough 204 may be further provided with one or more condensate outlet 208 fittings to remove the collected condensate.

In one or more embodiments, the heat exchanger 200 may be associated with an indoor unit of a heat pump, which can be further fluidically connected to an outdoor unit of the heat pump via conduits, a compressor, a reversing valve and an expansion device 112. During cooling mode/cycle, the indoor (ID) coils (microchannel tubes) of the heat exchanger 200 act as an evaporator, and the outdoor (OD) coils associated with the outdoor unit act as a condenser. Further, during heating mode/cycle, the ID coils of the heat exchanger 200 act as the condenser, and the OD coils associated with the outdoor unit acts as the evaporator. The heat pump may use round-tube plate fin (RTPF) coils as the OD coils in the outdoor unit and the microchannel tubes of the indoor unit may be the ID coils.

During cooling cycle, liquid refrigerant passes through the expansion device 112, changing to a low-pressure liquid/vapor mixture that then goes to microchannel tubes 106 of the ID coil (which acts as the evaporator) via the supply tube 114, the auxiliary header 108, the tube stubs 110, and the first header 102. The low-pressure liquid/vapor mixture enters into the auxiliary header 108 via the supply tube 114 and then enters into the first header 102 of the indoor unit through the tube stubs 110, leading homogeneous two-phase flow. The tube stubs 110 and auxiliary header 108 act as a distributor that enhances the port-to-port distribution in the microchannel tubes 106 within the first header 102 without an increase in the pressure drop. The liquid refrigerant then flows into the microchannel tubes 106 and absorbs heat from the indoor air flowing across the microchannel tubes 106 of the indoor unit and boils, thereby becoming a low-temperature vapor. This vapor is then compressed by the compressor, reducing its volume and causing it to heat up. Finally, the gas, which is now hot, passes through the reversing valve to the OD coil (which acts as the condenser). The heat from the hot gas is transferred to the outdoor air, causing the refrigerant to condense into a liquid. This liquid returns to the expansion device 112, and the cycle may be repeated.

During the heating cycle, the liquid refrigerant passes through the expansion device 112, changing to a low-pressure liquid/vapor mixture that then goes to the OD coil (which acts as the evaporator). The liquid refrigerant absorbs heat from the outdoor air and boils, becoming a low-temperature vapor. This vapor is then compressed, reducing its volume and causing it to heat up. Finally, the reversing valve sends the gas, which is now hot, to the ID coil (which is the condenser). The heated gas enters the second header 104 and flows into the first header 102 via the microchannel tubes/ID coil 106. The heat from the hot gas is transferred to the indoor air flowing across the ID coils 106, causing the refrigerant to condense into a liquid. This liquid then goes into the auxiliary header 108 via the first header 102 and the tube stubs 110. The liquid then returns to the expansion device 114 and the cycle is repeated.

It is to be appreciated that the auxiliary header 108 acts as a compensator (in addition to the refrigerant distributor) or a passive refrigerant charge balancing system in the heat pump, and can store the excess charge generated in the heat pump due to a refrigerant charge imbalance between the heating cycle and cooling cycle in the heat pump, and without any control strategy. In addition, as the auxiliary header 108 (which acts as a compensator or passive refrigerant charge balancing system) facilitates refrigerant charge balancing in the heat pump, the auxiliary header 108 enables the use of round-tube plate fin (RTPF) coils as the OD coils in the outdoor unit along with the microchannel tubes as the ID coils in the heat pump.

It should be obvious to a person skilled in the art that while FIGS. 2A and 2B and some embodiments of this invention have been elaborated for the V-coil arrangement heat exchanger for the sake of simplicity and better explanation purpose, however, the teachings of this invention are equally applicable for other heat exchangers having upward or downward fluid flow configuration such as A-coil heat exchanger, slab-design heat exchanger, N-coil heat exchanger, J-coil heat exchanger, U-coil heat exchanger, and the like, and all such embodiments are well within the scope of this invention.

Thus, this invention overcomes the drawbacks, limitations, and shortcomings associated with existing technologies by providing a simple, compact, and efficient refrigerant distributor cum charge balancing system for the primary header of heat exchangers, which enables even distribution of refrigerant across ports of the tubes within the header of the heat exchanger with minimal pressure drop and also facilitates charge balancing and compensation.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A refrigerant distribution and charge balancing system for a heat exchanger, the system comprising:

an auxiliary header adapted to be fluidically coupled to a first header of the heat exchanger using one or more tube stubs;

wherein the auxiliary header is configured at a predefined distance from the first header, and wherein the auxiliary header is adapted to be fluidically coupled to a supply tube associated with a refrigerant line of the heat exchanger; wherein the supply tube is directly disposed into an interior of the auxiliary header through a flat base at one end of the auxiliary header, the supply tube extending parallel to a longitudinal axis of the auxiliary header.

2. The system of claim 1, wherein the heat exchanger is a microchannel heat exchanger comprising:

the first header;

a second header; and a plurality of microchannel tubes extending between and fluidically coupling the first header and the second header, wherein the auxiliary header is disposed within a housing of the heat exchanger in an area between the first header and the second header and in proximity to the first header.

3. The system of claim 1, wherein the auxiliary header is configured parallel from the first header at a predefined height above the first header, wherein the first header and the second header are configured horizontally over a support structure such that the first header is positioned at an elevated height above the second header.

4. The system of claim 1, wherein the one or more tube stubs protrudes from the auxiliary header and extends up to the first header making a predefined angle from a horizontal plane of the auxiliary header in a downward direction.

5. The system of claim 1, wherein each of the tube stubs is a hollow member whose longitudinal axis is oriented perpendicular to a longitudinal axis of the auxiliary header, and wherein the plurality of tube stubs are configured parallelly with a predefined gap therebetween.

6. The system of claim 1, wherein a cylindrical surface of the auxiliary header comprises a plurality of first slots, and a cylindrical surface of the first header comprises a plurality of second slots, and wherein each of the first slots is adapted to accommodate a first end of one of the plurality of the tube stubs and each of the second slots is adapted to accommodate a second end of the corresponding tube stubs, such that the plurality of tube stubs extend parallelly between the auxiliary header and the first header, wherein an opening at the auxiliary-header end of each tube stub is smaller than an opening at a first-header end such that each tube stub acts as a nozzle.

7. The system of claim 1, wherein the auxiliary header has a predefined radius greater than a radius of the first header.

8. The system of claim 1, wherein the auxiliary header has a predefined radius less than or equal to a radius of the first header.

9. The system of claim 1, wherein a distributor nozzle is fitted at an outlet of the supply tube within the auxiliary header such that refrigerant ejected by the nozzle nearly covers an entire diameter and an entire length of the auxiliary header.

10. A heat exchanger comprising:

a first header;

a second header fluidically coupled to the first header; and an auxiliary header fluidically coupled to the first header using one or more tube stubs;

wherein the auxiliary header is configured at a predefined distance from the first header, and wherein the auxiliary header is adapted to be fluidically coupled to a supply tube associated with a refrigerant line of the heat exchanger; wherein the supply tube is directly disposed into an interior of the auxiliary header through a flat base at one end of the auxiliary header, the supply tube extending parallel to a longitudinal axis of the auxiliary header.

11. The heat exchanger of claim 10, wherein the heat exchanger comprises a plurality of microchannel tubes extending between and fluidically coupling the first header and the second header of the heat exchanger, wherein the auxiliary header is disposed within a housing of the heat exchanger in an area between the first header and the second header and in proximity to the first header.

12. The heat exchanger of claim 10, wherein the heat exchanger comprises a plurality of heat-dissipating fins extending between adjacent tubes among the plurality of microchannel tubes.

13. The heat exchanger of claim 10, wherein the heat exchanger comprises an auxiliary distributor fluidically coupled to the supply tube within the auxiliary header.

14. The heat exchanger of claim 10, wherein the heat exchanger is associated with an indoor unit that is adapted to be fluidically coupled to a plurality of round tube plate fins (RTPF) coils associated with an outdoor unit.

15. The heat exchanger of claim 10, wherein the auxiliary header is configured parallelly at a predefined height above the first header, wherein the first header and the second header are configured horizontally over a support structure such that the first header is positioned at an elevated height above the second header.

16. The heat exchanger of claim 10, wherein the plurality of tube stubs protrudes from the auxiliary header and extends up to the first header making a predefined angle from a horizontal plane of the auxiliary header in a downward direction.

17. The heat exchanger of claim 10, wherein each of the tube stubs is a hollow member whose longitudinal axis is oriented perpendicular to a longitudinal axis of the auxiliary header, and wherein the plurality of tube stubs extends parallelly with a predefined gap therebetween.

18. The heat exchanger of claim 10, wherein a cylindrical surface of the auxiliary header comprises a plurality of first slots and a cylindrical surface of the first header comprises a plurality of second slots, and wherein each of the first slots is adapted to accommodate a first end of one of the plurality of the tube stubs, and each of the second slots is adapted to accommodate a second end of the corresponding tube stubs, such that the plurality of tube stubs extend parallelly between the auxiliary header and the first header, wherein an opening at the auxiliary-header end of each tube stub is smaller than an opening at a first-header end such that each tube stub acts as a nozzle.

19. The heat exchanger of claim 10, wherein the one or more tube stubs have a varying diameter along a longitudinal axis of the first header, wherein the diameter of the one or more tube stubs increases or decreases from a first end to a second end of the first header.

20. The heat exchanger of claim 10, wherein a distributor nozzle is fitted at an outlet of the supply tube within the auxiliary header such that refrigerant ejected by the nozzle nearly covers an entire diameter and an entire length of the auxiliary header.

* * * * *